US008565470B2

(12) United States Patent
Kobayashi et al.

(10) Patent No.: US 8,565,470 B2
(45) Date of Patent: Oct. 22, 2013

(54) ELECTROACOUSTIC TRANSDUCER

(75) Inventors: Yuki Kobayashi, Daito (JP); Yuji Matsuo, Daito (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 209 days.

(21) Appl. No.: 13/112,439

(22) Filed: May 20, 2011

(65) Prior Publication Data

US 2011/0293131 A1 Dec. 1, 2011

(30) Foreign Application Priority Data

May 26, 2010 (JP) ..... 2010-120642

(51) Int. Cl.
*H04R 25/00* (2006.01)

(52) U.S. Cl.
USPC ..... 381/386; 381/398; 381/433; 181/149

(58) Field of Classification Search
USPC ..... 381/386, 396, 398, 433, 412; 181/148, 181/171, 198, 199, 149
See application file for complete search history.

(56) References Cited

U.S. PATENT DOCUMENTS 5,850,461 A * 12/1998 Zelinka ..... 381/398
2005/0271236 A1* 12/2005 Kobayashi et al. ..... 381/396
2007/0165901 A1* 7/2007 Hayasaka et al. ..... 381/386

FOREIGN PATENT DOCUMENTS

JP 2009-004821 A 1/2009

* cited by examiner

*Primary Examiner* — Curtis Kuntz
*Assistant Examiner* — Joshua Kaufman
(74) *Attorney, Agent, or Firm* — Westerman, Hattori, Daniels & Adrian, LLP

(57) ABSTRACT

A frame has a diaphragm's edge attached thereto. An attachment member has a frame portion and a hook. The frame portion has a first plane to be bonded to a casing, and a second plane opposite to the first plane. The hook is supported by the frame portion and also opposite to the second plane with a gap interposed. The frame at the portion having the diaphragm's edge attached thereto is fitted into the gap. A securing member secures the edge and the second plane together.

4 Claims, 5 Drawing Sheets

ELECTROACOUSTIC TRANSDUCER

This nonprovisional application is based on Japanese Patent Application No. 2010-120642 filed on May 26, 2010 with the Japan Patent Office, the entire contents of which are hereby incorporated by reference.

BACKGROUND OF THE INVENTION

1. Field of the Invention

The present invention relates generally to electroacoustic transducers and particularly to electroacoustic transducers having a diaphragm.

2. Description of the Related Art

Mobile phones and other similar electronics have an electroacoustic transducer mounted therein. The electroacoustic transducer is a device transducing an electrical signal to an acoustic signal and vice versa, such as a speaker or a microphone. A typical electroacoustic transducer has a diaphragm having an edge secured to a frame. When an electroacoustic transducer is required to be significantly waterproof, it is preferable that the diaphragm has its edge in close contact with the frame to prevent water leakage therebetween.

Japanese Patent Laying-open No. 2009-004821 discloses a structure having a casing and a speaker attached thereto, with a gasket interposed for waterproofing. The gasket has a projection to contact an edge of a diaphragm of the speaker. When the speaker is pressed against and thus attached to the casing, the projection presses the diaphragm's edge to the frame and thus prevents the diaphragm from having its edge peeled off the frame.

In pressing the diaphragm's edge, the projection exerts force, which is caused as the speaker and the casing pinch the gasket. Accordingly, the force significantly depends on how the speaker is attached to the casing. As a result, the waterproof property between the diaphragm's edge and the frame, i.e., that of the speaker per se, significantly depends on how the speaker is attached to the casing. As such, how the attachment of the speaker to the casing varies contributes to how the speaker's (or electroacoustic transducer's) waterproof property varies.

SUMMARY OF THE INVENTION

The present invention has been made in view of the above issue and it contemplates an electroacoustic transducer that is not significantly affected in keeping it waterproof by how it is attached to a casing.

The present electroacoustic transducer is attachable to close an opening of a casing, and includes a diaphragm, a frame, an attachment member, and a securing member. The diaphragm has an edge and a vibrating portion surrounded by the edge and capable of vibration. The frame has the diaphragm's edge attached thereto. The attachment member includes a frame portion and a hook. The frame portion has a first plane to be bonded to the casing and a second plane opposite to the first plane. The hook is supported by the frame portion and opposite to the second plane with a gap interposed. A portion of the frame that has the diaphragm's edge attached thereto is fitted in the gap. The securing member secures the diaphragm's edge and the second plane together.

The present electroacoustic transducer has fitted in the attachment member's gap that portion of the frame having the diaphragm's edge attached thereto. This can prevent the diaphragm from having its edge peeled off the frame. This can in turn maintain a waterproof property between the diaphragm's edge and the frame, i.e., ensure that the electroacoustic transducer is waterproof. Furthermore, this fitting is done by the attachment member and the securing member, i.e., a member of the electroacoustic transducer per se. The electroacoustic transducer is thus not significantly influenced in keeping it waterproof by how it is attached to the casing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter the present invention in embodiment will be described.

Figure 1:
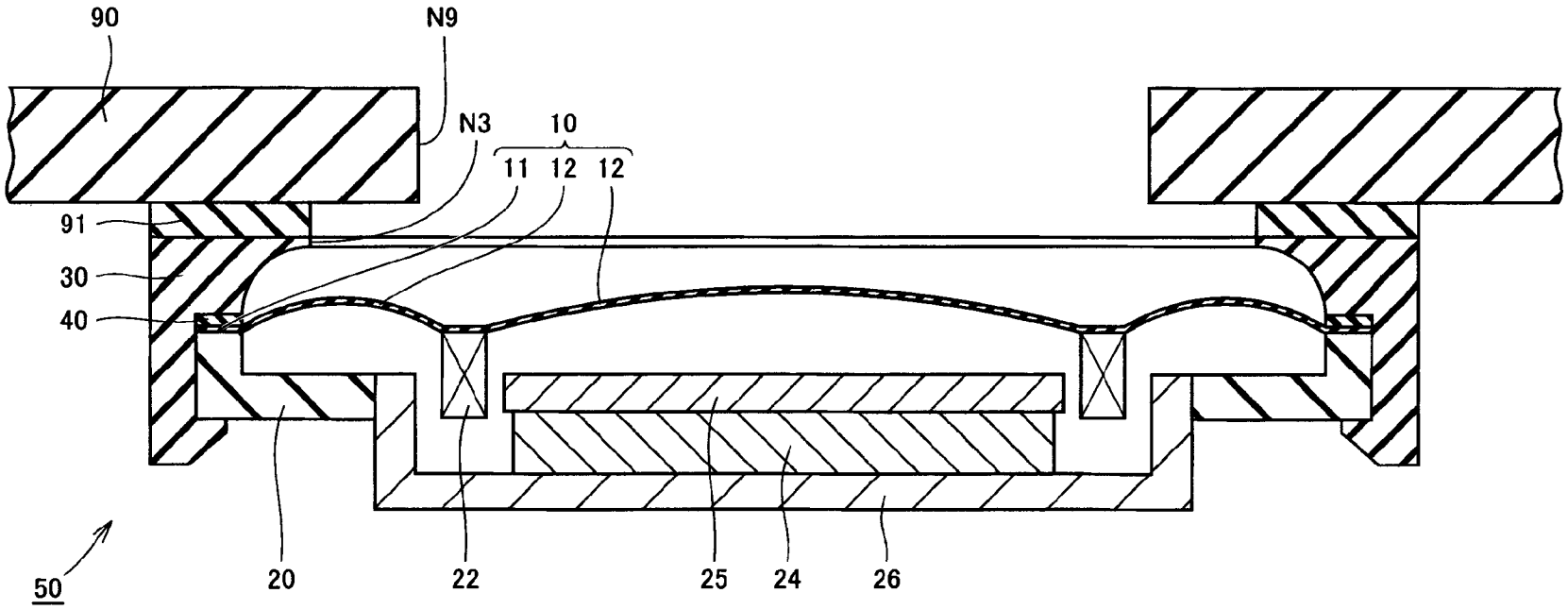
FIG. 1 is a schematic cross section in configuration of the present electroacoustic transducer in one embodiment in the form of a speaker.
Figure 2:
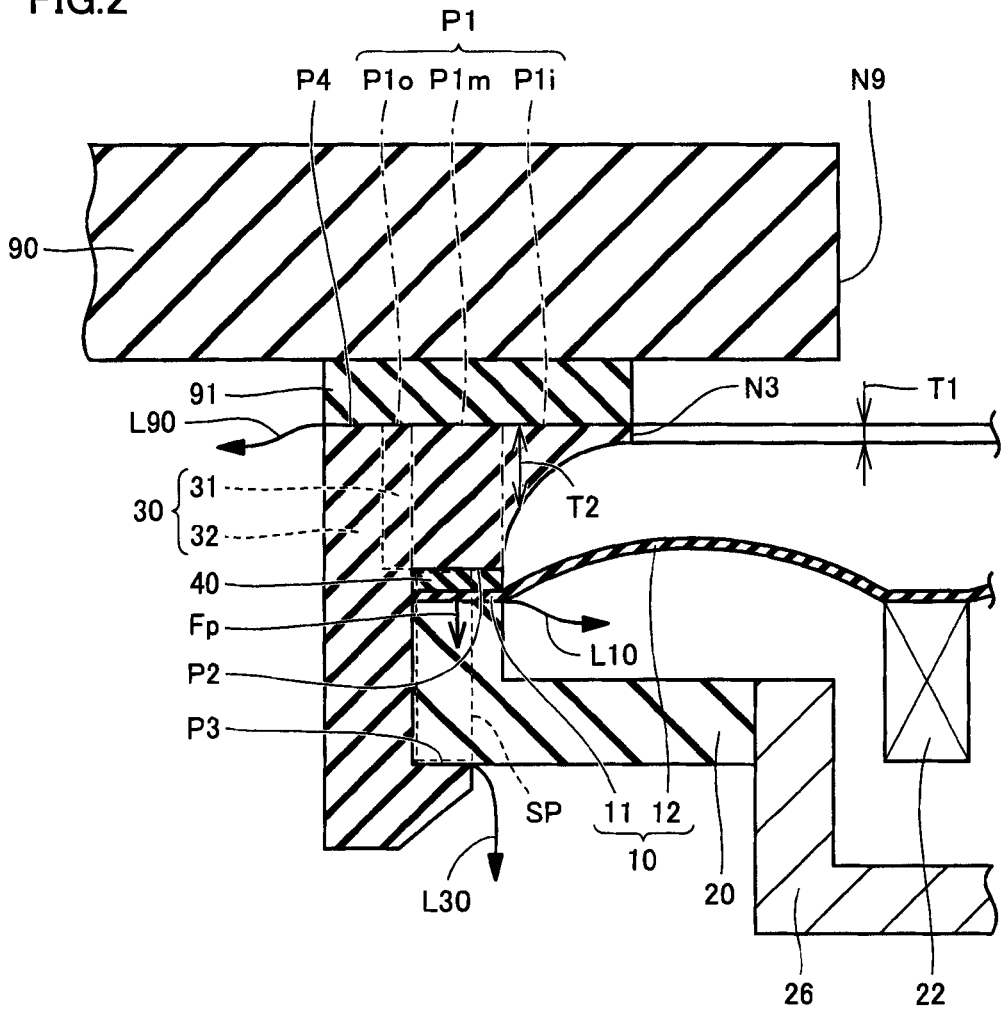
FIG. 2 is a partially enlarged view of FIG. 1.

With reference to FIG. 1 and FIG. 2, the present embodiment provides an electroacoustic transducer in the form of a speaker 50. In the figures, in addition to speaker 50, a casing 90 to which speaker 50 is attached and a double-faced tape 91 for this attachment are also shown. As illustrated, speaker 50 is attachable to close an opening N9 of casing 90. Speaker 50 has a diaphragm 10, a frame 20, a frame cover (an attachment member) 30, a securing member 40, a voice coil 22, a magnet 24, a plate 25, and a yoke 26. Casing 90 is for example that for a mobile phone or similar electronics.

Diaphragm 10 has an edge 11 and a vibrating portion 12 surrounded by edge 11 and capable of vibration. Diaphragm 10 is formed to be impermeable to water and is formed for example of synthetic resin, such as polyethylene terephthalate (PET), polyethylene naphthalate (PEN), polyetherimide (PEI), or the like. Vibrating portion 12 has voice coil 22 attached thereto for driving vibrating portion 12 in response to an electrical signal. Edge 11 is attached to frame 20.

Figure 3:
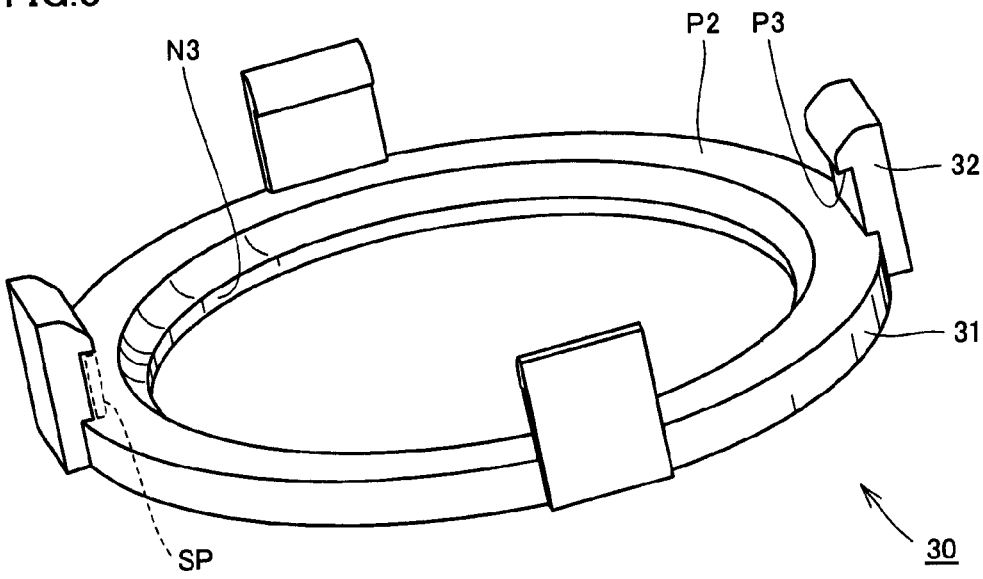
FIG. 3 is a schematic perspective view in configuration of an attachment member of the FIG. 1 speaker.

Furthermore, with reference to FIG. 3, frame cover 30 is a resin mold having a frame portion 31 and a hook 32 molded in one piece.

Frame portion 31 is a member in the form of a frame having an opening N3 (see FIG. 3). Furthermore, frame portion 31 has a plane P1 (or a first plane) to be bonded to casing 90 (see FIG. 2). Plane P1 has planes P1*i*, P1*o*, and P1*m* located in a single plane. Plane P1*i* is located inner than plane P1*m* and plane P1*o* is located outer than plane P1*m*. Furthermore, frame portion 31 has a plane P2 (or a second plane) opposite to plane P1*m*. Thus, plane P1*i* is inner than plane P2, as seen in a plane as seen in a direction in which planes P1 and P2 are opposite to each other (i.e., when FIG. 2 is seen from above).

Frame portion 31 at a portion forming plane P1*i* has an inner end having a thickness (i.e., a dimension along the direction in which planes P1 and P2 are opposite to each other) T1, and frame portion 31 at its outer end, i.e., a side immediately adjacent to a portion forming plane P1*m*, has a thickness T2. Thickness T2 is larger than thickness T1 and plane P1*i* is thus resistant to deformation.

Hook 32 is molded with frame portion 31 in one piece and thus supported by frame portion 31. Hook 32 has a plane P3 opposite to plane P2 with a gap SP interposed (see FIG. 3). Frame 20 has a portion with edge 11 attached thereto, and the portion is fitted in gap SP (see FIG. 2), and securing member 40 secures edge 11 and plane P2 together. Hook 32 has a plane P4 flush with plane P1. Planes P1 and P4 are bonded to casing 90 via double-faced tape 91. In other words, planes P1 and P4 configure a bonding surface to be bonded to casing 90.

Preferably, securing member 40 seals between edge 11 and plane P2 of frame cover 30 to prevent water leakage therebetween. Accordingly, securing member 40 is preferably formed of material impermeable to water, such as synthetic resin.

Furthermore, preferably, securing member 40 is pinched between edge 11 supported by frame 20 and plane P2 of frame cover 30 and thus compressed depthwise (i.e., in a vertical direction in FIG. 2). Securing member 40 thus compressed exerts resilient force Fp (see FIG. 2) and thus presses edge 11 of diaphragm 10 against frame 20, and thus provides an enhanced waterproof property therebetween. Furthermore, preferably, securing member 40 is double-faced tape. This facilitates securing securing member 40 to both plane P2 of frame cover 30 and edge 11 of diaphragm 10.

Two comparative examples will be described hereinafter.

Figure 4:
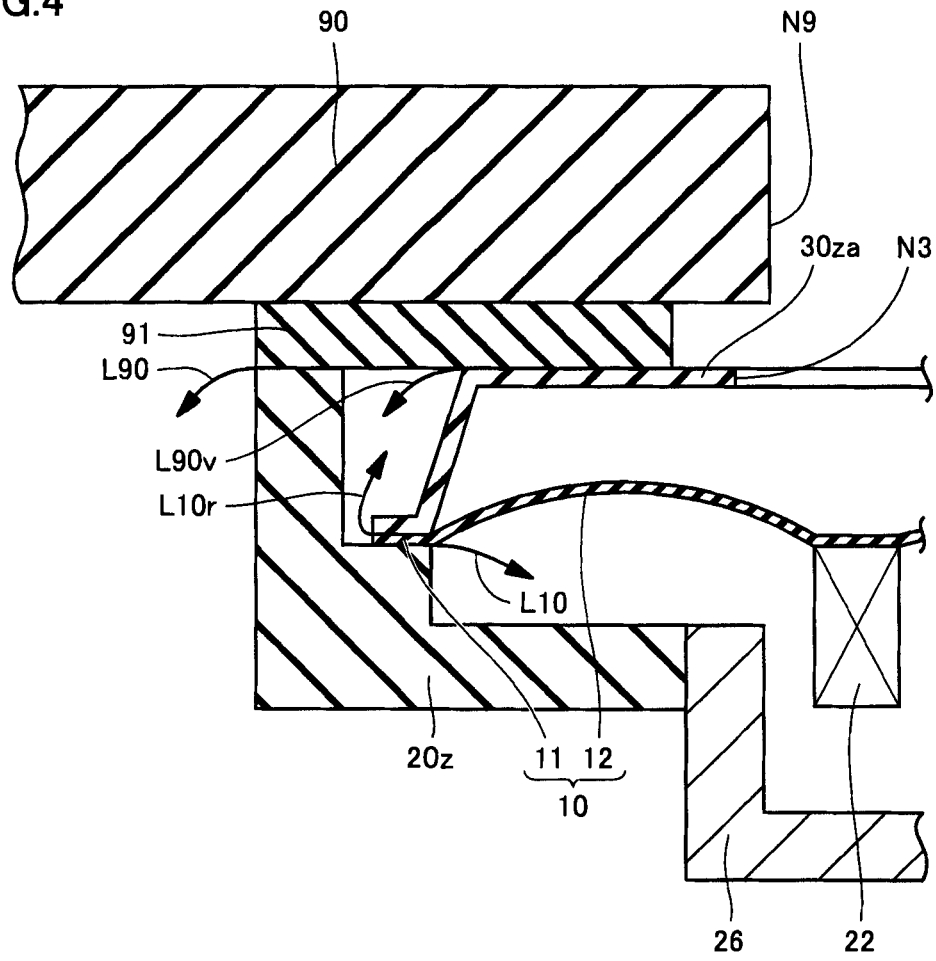
FIGS. 4 and 5 are partial cross sections of speakers in first and second comparative examples.

With reference to FIG. 4, a first comparative example provides a speaker such that casing 90 is bonded to a surface configured of two components, i.e., a frame 20*z* and a frame cover 30*za*. It is difficult to ensure that a plurality of components configure a bonding surface to be flat with high precision, and as a result, at least water leakage L90*v* or L90 is causable.

Furthermore, there is a cavity between frame cover 30*za* and double-faced tape 91, and accordingly, frame cover 30*za* is relatively prone to deformation. In particular, if frame cover 30*za* is formed of a thin metal plate processed into sheet metal, it is difficult to provide frame cover 30*za* with a complicated geometry to prevent it from deformation, and frame cover 30*za* is thus prone to deformation. As a result, at least water leakage L90*v*, L10*r*, or L10 is causable.

Furthermore, frame cover 30*za* deformed may cause not only water leakage but also unusual noise or poor sound quality.

Figure 5:
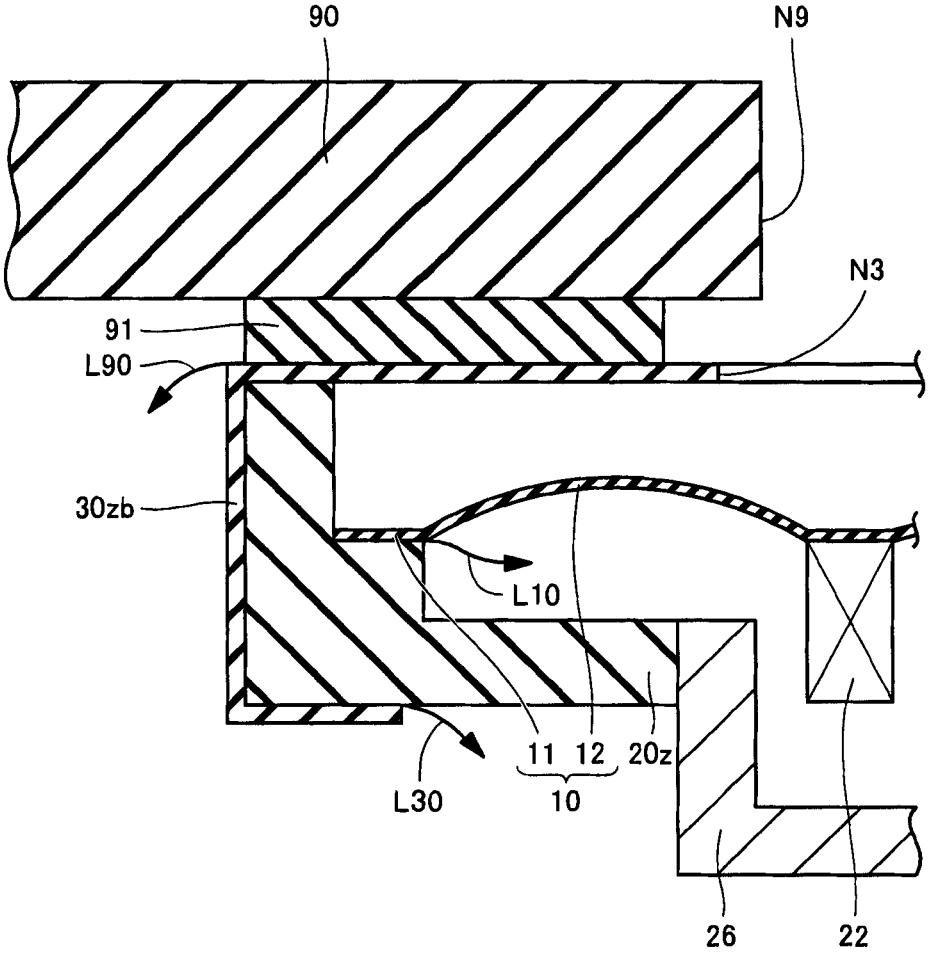

With reference to FIG. 5, a second comparative example provides a speaker such that casing 90 is bonded to a surface configured of a frame cover 30*zb*. There is a cavity between frame cover 30*zb* and the diaphragm 10 edge 11 and accordingly, frame cover 30*zb* is relatively prone to deformation. In particular, if frame cover 30*zb* is formed of a thin metal plate processed into sheet metal, it is difficult to provide frame cover 30*zb* with a complicated geometry to prevent it from deformation, and frame cover 30*zb* is thus prone to deformation. As a result, at least water leakage L90 or L30 is causable.

Furthermore, while edge 11 of diaphragm 10 has a lower surface supported by a frame 20*z*, edge 11 has an upper portion with an open space thereabove. Edge 11 thus readily peels off frame 20*z*, and water leakage L10 is causable.

Furthermore, frame cover 30*zb* deformed may cause not only water leakage but also unusual noise or poor sound quality.

In contrast to these comparative examples, the present embodiment provides speaker 50 having fitted in gap SP that portion of frame 20 having edge 11 attached thereto (see FIG. 2). This can prevent edge 11 from peeling off frame 20, and hence water leakage L10. In other words, this can maintain a waterproof property between edge 11 and frame 20, i.e., ensure that speaker 50 is waterproof.

Furthermore, the above fitting is done by frame cover 30 and securing member 40. More specifically, it is done by a member of speaker 50 per se independently of a member other than speaker 50 (e.g., casing 90). Speaker 50 is thus not significantly influenced in keeping it waterproof by how it is attached to casing 90.

Furthermore, a surface of speaker 50 that is bonded to attach speaker 50 to casing 90 (see FIG. 2: planes P1 and P4) is configured of frame cover 30 alone. In other words, only a single member configures the bonding surface. In contrast to a bonding surface configured of a plurality of members (see FIG. 4), the bonding surface configured of a single member more readily ensures flatness with precision. As a result, water leakage L90 is less causable.

Furthermore, frame cover 30 not only has plane P1*m* but also plane P1*i* inner than plane P1*m* (see FIG. 2). This allows speaker 50 and casing 90 to be bonded across an increased area and can thus provide an enhanced waterproof property between speaker 50 and casing 90.

Furthermore, frame cover 30 has a portion located on edge 11 with securing member 40 interposed (i.e., a portion having plane P1*m* in FIG. 2). This portion has a lower surface supported by frame 20 via securing member 40 and edge 11, and has an upper surface (plane P1*m*) supported by casing 90 via double-faced tape 91. In other words, this portion is supported at both its upper and lower surfaces. This portion is thus less prone to displacement and frame cover 30 is thus prevented from deformation attributed to such displacement. Water leakage L90 is thus prevented.

Furthermore, preventing frame cover 30 from deformation, as described above, can also prevent unusual noise or poor sound quality.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An electroacoustic transducer attachable to close an opening of a casing, comprising:

a diaphragm which has an edge and a vibrating portion surrounded by said edge and capable of vibration;

a frame which has said edge attached thereto;

an attachment member which includes a frame portion having a first plane to be bonded to said casing and a second plane parallel to said first plane, and a hook supported by said frame portion and having a third plane parallel and vertically aligned to said second plane with a gap interposed, a portion of said frame that has said edge attached thereto being fitted in said gap so as to be sandwiched between said second and third planes; and a securing member which secures said edge and said second plane together, wherein said securing member is compressed and exerts resilient force as it is pinched between said second plane and said edge.

2. The electroacoustic transducer according to claim 1, wherein said first plane has a portion located inner than said second plane, as seen in a side cross section view.

3. The electroacoustic transducer according to claim 1, wherein said securing member is double-faced tape.

4. The electroacoustic transducer according to claim 1, wherein said attachment member is a resin mold.

* * * * *